United States Patent [19]

Marino

[11] Patent Number: 5,050,754

[45] **Date of Patent: * Sep. 24, 1991**

[54] CAP FOR A NECK FINISH ON A WIDE MOUTH CONTAINER

[75] Inventor: Michael Marino, New Castle, Pa.

[73] Assignee: West Penn Plastics, Inc., New Castle, Pa.

[ * ] Notice: The portion of the term of this patent subsequent to Oct. 30, 2007 has been disclaimed.

[21] Appl. No.: 537,253

[22] Filed: Jun. 13, 1990

Related U.S. Application Data

[63] Continuation-in-part of Ser. No. 424,915, Oct. 23, 1989, abandoned.

[51] Int. Cl.[5] ..... B65D 17/40

[52] U.S. Cl. ..... 215/256; 215/320; 215/354; 220/270; 220/276; 220/306

[58] Field of Search ..... 215/256, 250, 253, 254, 215/354, 319, 317, 320, 321; 220/270, 276, 306

[56] References Cited

U.S. PATENT DOCUMENTS

| | | | |
|---|---|---|---|
| 1,478,140 | 12/1923 | Orr | 215/254 |
| 3,073,472 | 1/1963 | Williams | 215/256 |
| 3,940,004 | 2/1976 | Faulstich . | |
| 3,980,195 | 9/1976 | Fillmore | 215/256 |
| 4,305,517 | 12/1981 | Dennis . | |
| 4,380,304 | 4/1983 | Anderson | 220/306 |
| 4,438,857 | 3/1984 | Bullock, III . | |
| 4,593,830 | 6/1986 | Bullock | 215/256 |
| 4,625,876 | 12/1986 | Bullock, III . | |
| 4,691,834 | 9/1987 | Bullock, III . | |
| 4,708,259 | 11/1987 | Olimpio | 220/306 |
| 4,712,705 | 12/1987 | Fuehrer | 215/254 X |
| 4,721,210 | 1/1988 | Lawrence et al. | 215/254 X |
| 4,723,676 | 2/1988 | Kabayashi et al. | 215/301 |
| 4,727,998 | 3/1988 | Simon | 215/254 X |
| 4,798,301 | 1/1989 | Bullock et al. . | |
| 4,966,292 | 10/1990 | Marino | 215/256 |

FOREIGN PATENT DOCUMENTS

| | | | |
|---|---|---|---|
| 70558 | 12/1958 | France | 215/354 |
| 1263129 | 4/1961 | France | 215/254 |
| 2265628 | 10/1975 | France | 215/254 |
| 684795 | 3/1965 | Italy | 215/254 |
| 6406103 | 1/1964 | Netherlands | 215/254 |

*Primary Examiner*—Stephen Marcus
*Assistant Examiner*—Stephen Cronin
*Attorney, Agent, or Firm*—Harpman & Harpman

[57] ABSTRACT

A cap of the type having a top portion with a depending annular flange on its peripheral edge and an annular depending sealing flange inwardly thereof between which the neck of a container is sealingly engaged is disclosed in which the depending annular flange of the cap has a lower annular outwardly offset secondary flange for registry with a similarly shaped neck finish of the container. An upstanding tab is integrally formed on the lower annular outwardly offset secondary flange of the depending annular flange. The inner surface of the depending annular flange and the outer surface of the neck finish have cooperating upper and lower annular fastening and sealing configurations holding the cap in place until the lower annular outwardly offset secondary flange of the depending annular flange is removed by tearing along a horizontal frangible line which also removes the lower fastening and sealing configuration.

5 Claims, 1 Drawing Sheet

CAP FOR A NECK FINISH ON A WIDE MOUTH CONTAINER

This is a CIP of patent application filed Oct. 23, 1989, Ser. No. 07/424,915 now abandoned.

BACKGROUND OF THE INVENTION

1. Technical Field

This device relates to so-called wide mouth containers and closures therefore of tamper resistant type.

2. Description of Prior Art

Prior Art devices of this type may be seen in U.S. Pat. Nos. 3,940,004, 4,438,857, 4,625,876, 4,691,834, 4,798,301 and 4,305,517. In each of these patents caps formed of plastic material that is somewhat resilient and deformable are provided for containers of a similar plastic material, such containers and caps are relatively inexpensive and generally are considered expendable.

In U.S. Pat. No. 4,305,517 a tamper-proof closure is disclosed with a depending annular flange and an interdepending sealing flange in spaced relation thereto. A single annular inturned locking rib extends from the depending annular flange in spaced relation to a neck finish upon which the closure is positioned in use.

One of the major problems with the prior art devices as resided in the tamper indicating construction which are sometimes accidentally opened or partially removed resulting in the inability of the product in the container to be sold and the damage that occurs when the product in the container is accidentally released as in shipment.

The present invention provides a cap for a neck finish of a wide mouth container, for example a 110 mm wide mouth container and provides positive retention of the cap on the neck finish, of the wide mouth container during shipping and handling and at the same time provides a relatively simple easy to use tear skirt construction facilitated by a tear tab and at the same time provides a resilient deformable fastening structure also useful when the cap is replaced on the container.

SUMMARY OF THE INVENTION

A cap for a wide mouth container has a depending annular flange on the top of the cap with a lower annular outwardly offset secondary flange with a horizontal flange tear line in the depending annular flange closely above the lower annular outwardly offset secondary flange. An upstanding tab is formed on the lower annular outwardly offset secondary flange. A frangible tear line extends from the horizontal tear line to the lower edge of the cap. The inner surfaces of the depending annular flange and the lower annular outwardly offset secondary flange have ribs thereon for engagement with ribs and grooves in the neck finish of a container.

DESCRIPTION OF THE PREFERRED EMBODIMENT

Figure 1:
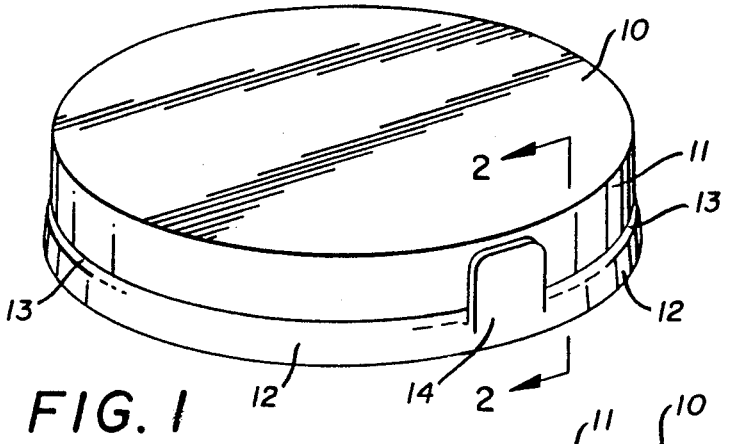
FIG. 1 is a perspective elevation of the cap of the present invention.

This invention relates to a new and improved tamper evident cap for engagement on the neck finish of a wide mouth container. By referring to FIG. 1 of the drawings it will be seen that the cap has a top portion 10 with a depending annular flange 11 on the periphery thereof. The lower portion of the depending annular flange 11 takes the form of a lower annular outwardly offset secondary flange 12, the junction between the upper portion 11 of the depending annular flange and the lower annular outwardly offset secondary flange 12 comprising an outwardly and downwardly curving section 13.

Figure 2:
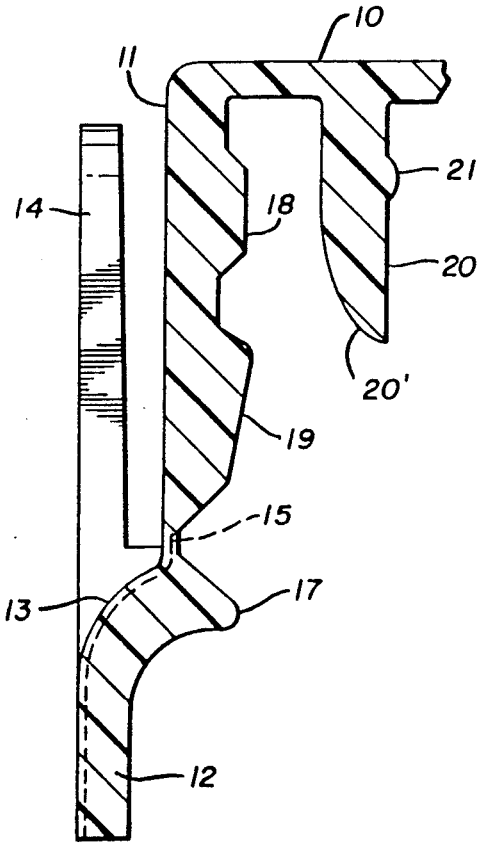
FIG. 2 is an enlarged vertical section of the cap on line 2—2 of FIG. 1.

An upstanding pull tab 14 is integrally formed with the lower annular outwardly offset secondary flange 12 so as to extend outwardly from the outwardly and downwardly curving section 13 thereof as best seen in FIGS. 1 and 2 of the drawings.

Figure 4:
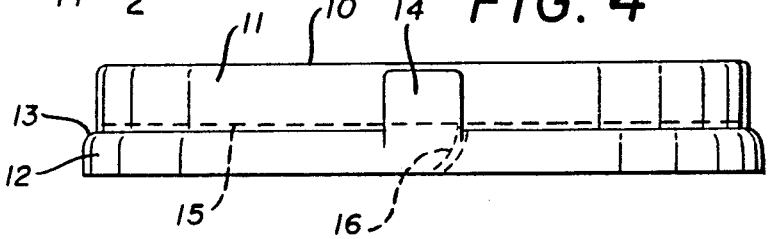
FIG. 4 is a side elevation of the cap.

Referring now to FIG. 4 of the drawings it will be seen that a horizontally frangible tear line 15 extends circumferentially around the depending annular flange 11 immediately above the outwardly and downwardly curving section 13 from which the lower annular outwardly offset secondary flange 12 depends. A curving frangible line 16 extends from the horizontal frangible line 15 beside the pull tab 14 to the lowermost edge of the lower annular outwardly offset secondary flange 12. It will be seen that grasping the pull tab 14 and moving it outwardly with respect to the depending annular flange 11 will remove the lower annular outwardly offset secondary flange 12 from the cap leaving almost all of the portion of the depending annular flange 11 above the frangible tear line 15.

By referring now to FIG. 2 of the drawings it will be seen that the cap of the present invention as illustrated in the enlarged vertical section comprises the top portion 10 with its depending annular flange 11 on the periphery thereof. The lower portion of the depending annular flange 11 comprising the lower annular outwardly offset secondary flange 12 being connected to the depending annular flange 11 by the outwardly and downward curving section 13. The upstanding tab 14 is formed on the outwardly and downwardly curving section 13 of the lower annular outwardly offset secondary flange 12 and it will be seen that the horizontal frangible line 15 herinbefore referred to with respect to FIG. 4 of the drawings is illustrated as circumferentially weakened area 15. Still referring to FIG. 2 it will be seen that an annular rib 17 is formed on the upper inner side of the outwardly and downwardly curving section 13 and that it extends inwardly a distance comparable with a wide flat rib 18 and a downwardly spaced thickened tapered section 19 formed on the inner surface of the depending annular flange 11. It will also be seen that the top portion 10 positions an annular depending sealing flange 20 inwardly of the annular depending flange 11 and in oppositely disposed relation to the wide flat rib 18 on the inner surface of the depending annular flange 11.

An annular reinforcing rib 21 is formed on the inner surface of the annular depending sealing flange 20 and it will be observed that the annular depending sealing flange 20 is thicker than the top portion 10 of the cap and as thick in cross-section as the depending annular flange 11 and the wide flat rib 18 positioned opposite thereto. The upper end of the neck finish 22 includes an annular inturned flange 23 of a known width and the annular space between the wide flat rib 18 and the sealing flange 20 is less than said known width so that moving the cap onto the neck finish 23 causes the wide flat rib 18 to increase the sealing pressure on the neck of the container by urging the annular same against the depending sealing flange 20.

Figure 3:
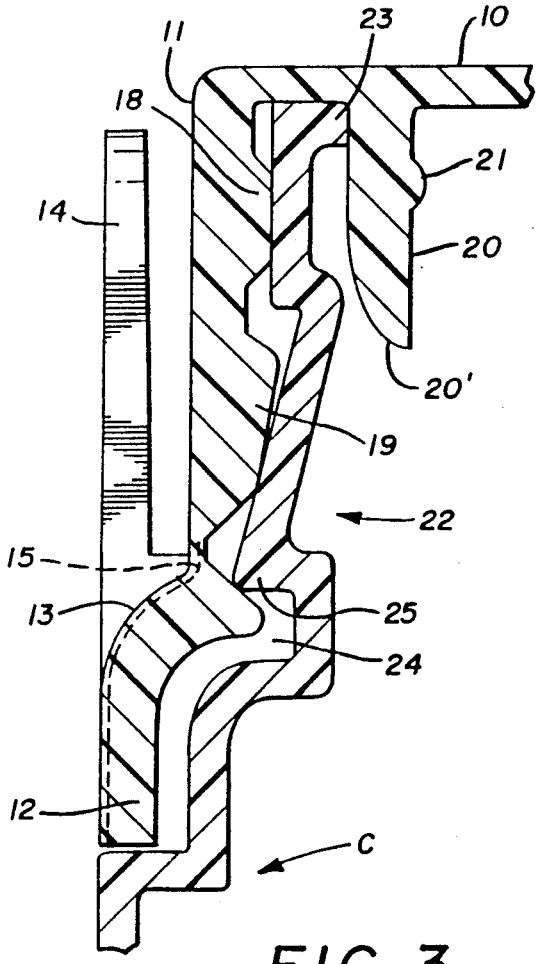
FIG. 3 is an enlarged vertical section of the cap on line 2—2 of FIG. 1 positioned on the neck finish of a container.

By referring now to FIG. 3 of the drawings, a cylindrical neck portion 22 of a commercially available blow molded container C is illustrated in enlarged cross-section with the cap of the present invention positioned thereon and it will be seen that the wide flat rib 18 on the inner surface of the depending annular flange 11 of the cap is of a size that will engage several different finishes on the cylindrical neck portion 22 of a typical wide mouth container and that due to the resiliency of the plastic material of the cap of the invention the engagement of the cap over such neck finishes of the containers results in double sealing as well as frictional fastening between the cylindrical neck portion of a blow molded container and the inner engaging portions of the cap of the invention. For example, the upper surface of the inturned flange 23 of the cylindrical neck portion 22 as well as the inner annular portion of the inturned flange 23 form an L-shaped annular seal between the bottom of the top portion 10 and the outer surface of the annular depending sealing flange 20 which may be formed with a slight outward and downward inclination from the substantially vertical position illustrated by reason of a downwardly and inwardly curved lower outer portion 20' of the annular depending sealing flange 20. The thickened tapered section 19 of the depending annular flange 11 of the cap of the invention resiliently and deformably engages the usual outwardly tapering portions of the neck finish of a typical cylindrical neck portion of a blow molded container or the like and as such neck finishes usually provide an annular cavity such as illustrated in FIG. 3 and indicated by the numeral 24, the inturned annular rib 17 on the opposite inner surface of the outward and downward curving section 13 of the cap finds registry therein or alternately under an annular shoulder 25 of the neck finish on the cylindrical neck portion 22 of a typical blow molded container. Thus the formation of the inner portions of the cap of the invention will sealingly engage and frictionally fasten the cap to commercially available finishes on cylindrical neck portions of blow molded containers not specifically designed therefore and by reason of its novel inner configurations provide at least two and generally three sealing engaging surfaces in the depending annular flange 11 as well as an additional fastening configuration comprising the annular rib 17 on the lower annular outwardly inner surface of the offset secondary flange 12 of the cap.

Still referring to FIG. 3 of the drawings, it will be observed that when the tab 14 is grasped and pulled away from the cap, it will part at its line of weakness defined by the circumferential horizontal frangible line 15 which will remove only one of the fastening configurations, namely; the inturned annular rib 17 and thus leave at least two frictional fastening and sealing members which will both seal and hold the remaining portion of the cap on the finish of a cylindrical neck portion of a container at such time as the cap is originally positioned on the container as well as repositioned thereon after the lower annular outwardly offset secondary flange 12 and the pull tab 14 thereon have been removed therefrom.

It will thus be seen that a cap as disclosed herein will sealingly and fasteningly engage the finish of a cylindrical neck portion of a blow molded container or the like so as to provide at least dual sealing engagement areas and at least dual fastening areas of engagement with the finish of the cylindrical neck portion of a container and having thus described my invention, what I claim is:

1. A resilient deformable cap for engagement on a neck finish of a wide mouth container; said cap comprising a top portion having a depending annular flange on its peripheral edge and an annular depending sealing flange inwardly thereof, the space between the depending annular flange and said annular depending sealing flange being such that said neck finish will be sealingly engaged in said cap when said cap is positioned thereon; a wide flat rib on the inner surface of said depending annular flange for resilient sealing engagement with said neck finish, said wide flat rib being positioned in opposite relation to said annular depending sealing flange so as to urge a portion of said neck finish against said annular depending sealing flange; a thickened downwardly tapered section on the inner surface of said depending annular flange below said wide flat rib for resilient sealing and fastening engagement with said neck finish, said inner surface of said annular depending flange above said wide flat rib and below said top portion being of a known vertical dimension and the surface of said wide flat rib being of a vertical dimension twice that of said known vertical dimension of the inner surface of said annular depending flange so as to position said wide flat rib opposite said annular depending sealing flange midway between its upper and lower ends, an annular area of weakness in said depending annular flange below said thickened tapered section and extending therearound on a horizontal line, a lower annular outwardly offset secondary flange below said annular area of weakness for registry with said neck finish; an annular rib on the inner surface of said lower annular outwardly offset secondary flange defining the lower portion of said depending annular flange for sealing and fastening engagement with said neck finish; an upstanding pull tab on said lower outwardly offset secondary flange, an upward extending weakened area in said lower annular outwardly offset secondary flange adjacent said upstanding pull tab whereby said pull tab, said annular rib and said lower annular outwardly offset secondary flange may be manually removed from said cap whereby said wide flat rib and said thickened tapered section of said annular depending flange remain in fastening and sealing position with respect to said neck finish.

2. The cap of claim 1 in which the inner diameter of said depending annular flange is a known diameter and the outer diameter of said annular depending sealing flange is less than said known inner diameter of said depending annular flange and wherein the inner diameter of said wide flat rib is smaller than said known inner diameter of said depending annular flange and greater than said outer diameter of said annular depending sealing flange so as to define an area of reduced width between said wide flat rib and said oppositely disposed annular depending sealing flange.

3. The cap of claim 1 in which the inner diameter of the depending annular flange is a known diameter and the outer diameter of said annular depending sealing flange is less than said known inner diameter of said depending annular flange and wherein the inner diameter of said wide flat rib and the innermost diameter of said thickened downwardly spaced tapered section 19 of said depending annular flange are similar and smaller than the known inner diameter of said depending annular flange.

4. The cap of claim 1 in which an annular rib is formed on the inner surface of said annular depending sealing flange and the thickness of said annular depending sealing flange and annular rib thereon is equal to the thickness of said depending annular flange and said wide flat rib on the inner surface thereof and wherein said wide flat rib on the inner surface of said depending annular flange is spaced with respect to said top portion and spaced with respect to said thickened tapered section of said depending annular flange so as to position said wide flat rib in opposed relation to said annular depending sealing flange opposite said annular rib thereon.

5. A deformable flexible plastic cap for use with a wide mouth container neck having a cap receiving finish, said cap comprising a top portion having a depending annular flange on its periphery and an annular depending sealing flange inwardly thereof, a wide flat rib on the inner surface of said depending annular flange having an upper edge spaced with respect to said top portion, a reinforcing rib on the inner surface of said annular depending sealing flange, said wide flat rib forming a wide inwardly thickened area in said depending annular flange, said reinforcing rib forming an inwardly thickened area in said annular depending sealing flange, said thickened areas of said depending annular flange and said annular depending sealing flange being in oppositely disposed relation to one another, an annular downwardly and outwardly tapered section on the inner surface of said depending annular flange spaced below said wide flat rib thereon so as to define an annular channel in the inner surface of said depending annular flange, a lower annular outwardly offset secondary flange forming a portion of said depending annular flange below said downwardly and outwardly tapered section, an annular rib on the upper inner surface of said lower annular outwardly offset secondary flange, an area of weakness in said depending annular flange of said cap extending therearound between said downwardly and outwardly tapered section and said annular rib on said lower annular outwardly offset secondary flange, an upstanding pull tab on said lower annular outwardly offset secondary flange and an upwardly extending area of weakness in said lower annular outwardly offset secondary flange communicating with said section of weakness extending around said depending annular flange whereby moving said pull tab outwardly and away from said cap removes said outwardly offset secondary flange and said annular fastening rib from said cap.

* * * * *